US009620050B2

(12) United States Patent
Guo et al.

(10) Patent No.: US 9,620,050 B2
(45) Date of Patent: *Apr. 11, 2017

(54) DISPLAY METHOD AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Renwei Guo, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 37 days.

This patent is subject to a terminal disclaimer.

(21) Appl. No.: 14/437,002

(22) PCT Filed: Mar. 20, 2014

(86) PCT No.: PCT/CN2014/073791

§ 371 (c)(1),
(2) Date: Apr. 20, 2015

(87) PCT Pub. No.: WO2015/123908

PCT Pub. Date: Aug. 27, 2015

(65) Prior Publication Data

US 2016/0027369 A1 Jan. 28, 2016

(30) Foreign Application Priority Data

Feb. 21, 2014 (CN) ..... 2014 1 0059830

(51) Int. Cl.
*G09G 3/20* (2006.01)

(52) U.S. Cl.
CPC ..... *G09G 3/2074* (2013.01); *G09G 3/2003* (2013.01); *G09G 2300/0452* (2013.01);
(Continued)

(58) Field of Classification Search
None
See application file for complete search history.

(56) References Cited

U.S. PATENT DOCUMENTS 6,233,004 B1 * 5/2001 Tanaka ..... G06T 7/0024 348/39
6,967,651 B2 * 11/2005 Endoh ..... G06F 3/04815 345/428

(Continued)

*Primary Examiner* — Dismery Mercedes
(74) *Attorney, Agent, or Firm* — Nath, Goldberg & Meyer; Joshua B. Goldberg; Leonid D. Thenor

(57) ABSTRACT

The invention provides a display method and a display device. The display method comprises: generating a primary image based on image information, wherein the primary image is formed of virtual pixels arranged in a matrix, each virtual pixel is formed by multiple virtual sub-pixels of different colors arranged in one row, in the column direction, the size of the virtual pixel and that of the sub-pixel are the same; calculating a comparison component of each sub-pixel by using primary components of comparison virtual sub-pixels of the sub-pixel; acquiring differences between comparison components of each sub-pixel and other sub-pixels adjacent thereto, if each of the differences between comparison components of the sub-pixel and the other sub-pixels exceeds a predetermined threshold value, determining the sub-pixel as a highlighted sub-pixel; calculating a display component of each sub-pixel by using primary components of sampling virtual sub-pixels of the sub-pixel.

20 Claims, 6 Drawing Sheets

(52) U.S. Cl.
CPC ..... *G09G 2320/066* (2013.01); *G09G 2320/0626* (2013.01); *G09G 2320/0666* (2013.01); *G09G 2340/0457* (2013.01)

(56) References Cited

U.S. PATENT DOCUMENTS

| | | | | |
|---|---|---|---|---|
| 7,940,271 | B2 * | 5/2011 | Wright | G06F 17/30554 345/428 |
| 8,018,476 | B2 * | 9/2011 | Credelle | G09G 3/2074 345/690 |
| 9,094,602 | B2 * | 7/2015 | Kunugi | H04N 5/23212 |
| 9,177,527 | B2 * | 11/2015 | Nakagawa | H04N 9/67 |
| 9,311,841 | B2 * | 4/2016 | Nakagawa | G09G 3/3607 |
| 2002/0158873 | A1 * | 10/2002 | Williamson | G06T 15/20 345/427 |
| 2003/0059114 | A1 * | 3/2003 | Naoi | G06T 15/005 382/181 |
| 2004/0012609 | A1 * | 1/2004 | Taneja | G06T 11/40 345/611 |
| 2007/0268208 | A1 * | 11/2007 | Okada | G02F 1/133514 345/55 |
| 2009/0167657 | A1 * | 7/2009 | Tomizawa | G09G 3/2003 345/88 |
| 2014/0198245 | A1 * | 7/2014 | Kunugi | H04N 5/23212 348/349 |
| 2015/0015754 | A1 * | 1/2015 | Fujita | H04N 5/367 348/302 |
| 2016/0027359 | A1 * | 1/2016 | Guo | G09G 3/2003 345/694 |

* cited by examiner (1)

$$\begin{pmatrix} 0\%; & & 0\%; \\ 0\%; & 50\%; & 0\%; \\ 0\%; & & 0\%; \end{pmatrix}$$

(2)

$$\begin{pmatrix} 0\%; & & 10\% \\ 5\% & 60\% & 0\%; \\ 7\% & & 7\% \end{pmatrix}$$

(3)

$$\begin{pmatrix} 25\% & & 25\% \\ 15\% & 75\% & 15\% \\ 5\% & & 18\% \end{pmatrix}$$

(4)

$$\begin{pmatrix} 22\% & & 8\% \\ 0\% & 80\% & 8\% \\ 30\% & & 20\% \end{pmatrix}$$

weight coefficients of the sampling virtual sub-pixels of red sub-pixel (1)
$$\begin{pmatrix} 0.4; \\ 0.6; \end{pmatrix}$$

(2)
$$\begin{pmatrix} 0.2; \\ 0.8; \end{pmatrix}$$

(3)
$$\begin{pmatrix} -0.05; & 0.4; & -0.05; \\ -0.05; & 0.8; & -0.05; \end{pmatrix}$$

(4)
$$\begin{pmatrix} -0.03; & 0.4; & -0.03; \\ -0.03; & 0.72; & -0.03; \end{pmatrix}$$

weight coefficients of the sampling virtual sub-pixels of green sub-pixel (5)
$$\begin{pmatrix} 0.6; \\ 0.4; \end{pmatrix}$$

(6)
$$\begin{pmatrix} 0.8; \\ 0.2; \end{pmatrix}$$

(7)
$$\begin{pmatrix} -0.05; & 0.8; & -0.05; \\ -0.05; & 0.4; & -0.05; \end{pmatrix}$$

(8)
$$\begin{pmatrix} -0.03; & 0.72; & -0.03; \\ -0.03; & 0.4; & -0.03; \end{pmatrix}$$

weight coefficients of the sampling virtual sub-pixels of blue sub-pixel (9)
$$\begin{pmatrix} 0.6; \\ 0.4; \end{pmatrix}$$

(10)
$$\begin{pmatrix} 0.8; \\ 0.2; \end{pmatrix}$$

(11)
$$\begin{pmatrix} -0.05; & 0.8; & -0.05; \\ -0.05; & 0.4; & -0.05; \end{pmatrix}$$

(12)
$$\begin{pmatrix} -0.03; & 0.72; & -0.03; \\ -0.03; & 0.4; & -0.03; \end{pmatrix}$$

Fig. 8

DISPLAY METHOD AND DISPLAY DEVICE

FIELD OF THE INVENTION

The invention relates to the field of display technology, and particularly to a display method and a display device.

BACKGROUND OF THE INVENTION

As shown in FIG. 1, a conventional display panel consists of a plurality of square pixels 1, and each pixel 1 consists of three continuously arranged sub-pixels of different colors in the same row, for example, a red sub-pixel 11, a green sub-pixel 11 and a blue sub-pixel 11, wherein each sub-pixel 11 typically is rectangular strip-shaped, so that a square pixel 1 can be formed by arranging three sub-pixels 11 one by one. During displaying, display content of the three sub-pixels 11 in a pixel 1 are mixed so as to form a "display point" which is visible outside.

With the development of technology, resolution of the display panel is higher and higher, that is, the number of pixels per unit area is more and more, which requires the size of each sub-pixel to be smaller and smaller. However, because of constraints in process, obviously the size of the sub-pixel cannot be unlimitedly reduced.

To improve the display effect in a case that the size of the sub-pixel is fixed, a display panel of Pentile mode has been proposed. In the display panel of Pentile mode, the number of sub-pixels of certain colors (such as red sub-pixels and blue sub-pixels) is halved, at the same time, sub-pixels of different colors are regarded to be in different "layers", and every layer is divided into multiple sampling regions, wherein sampling regions in different layers are not overlapped, then content to be displayed by each sub-pixel is calculated by using area ratios of sampling regions. In the display panel of Pentile mode, some sub-pixels are "shared", so that a visual resolution is higher than the actual physical resolution.

However, the display effect of the display panel of Pentile mode is still unsatisfactory. Since the number of sub-pixels of certain colors is halved, the sub-pixels of various colors are distributed non-uniformly, which easily results in jagged lines, grid spots, the problem that fine content cannot be clearly displayed and the like. Meanwhile, since a calculation mode of "layer-dividing and region-dividing" is adopted, the content to be displayed by each sub-pixel is determined by complex calculation, thus amount of calculation is huge.

SUMMARY OF THE INVENTION

In view of the above problems of poor display effect and large amount of calculation in the existing high resolution display technology, the present invention provides a display method and a display device with high resolution, excellent display effect and small amount of calculation.

A solution to solve the above problems in the present invention is a display method, which is applicable to a display panel comprising multiple rows of sub-pixels, each row of sub-pixels are formed of sub-pixels of various colors which are alternately and cyclically arranged, the sub-pixels in respective rows are arranged in the same order, and in the column direction, sub-pixels of the same color are not adjacent, wherein the display method comprises steps of:

S1, generating a primary image based on image information, wherein the primary image is formed of virtual pixels arranged in a matrix, and each of the virtual pixels is formed of virtual sub-pixels of different colors arranged in one row;

S2, calculating a comparison component of each sub-pixel by using primary components of comparison virtual sub-pixels of the sub-pixel, wherein comparison virtual sub-pixels of the sub-pixel include multiple virtual sub-pixels, which are adjacent to a corresponding position of the sub-pixel in the primary image and have the same color as the sub-pixel;

S3, acquiring differences between comparison components of each sub-pixel and other sub-pixels adjacent thereto, if each of the difference between comparison components of the sub-pixel and the other sub-pixels adjacent thereto exceeds a predetermined threshold value, determining the sub-pixel as a highlighted sub-pixel; and S4, calculating a display component of each sub-pixel by using primary components of sampling virtual sub-pixels of the sub-pixel, wherein sampling virtual sub-pixels of one sub-pixel include multiple virtual sub-pixels, which are adjacent to a corresponding position of the one sub-pixel in the primary image and have the same color as the one sub-pixel, and sampling virtual sub-pixels of the highlighted sub-pixel is selected in a different manner from that for other sub-pixels.

Preferably, any two adjacent sub-pixels in the column direction are staggered by ½ sub-pixels in the row direction.

Preferably, the virtual pixel is square, and size of the virtual pixel in the column direction is the same as that of a sub-pixel of the display panel.

Further preferably, each row of sub-pixels in the display panel are formed of sub-pixels of three colors which are alternately and cyclically arranged, and each row of virtual sub-pixels of the primary image are formed by virtual sub-pixels of three colors which are alternately and cyclically arranged;

the sub-pixel is rectangular, and a ratio of length thereof in the row direction to length thereof in the column direction is 2:3; and a ratio of the size of the virtual pixel to that of the sub-pixel in the row direction is 3:2.

Preferably, the comparison sub-pixels of one sub-pixel include:

a virtual sub-pixel, which has the same color as the one sub-pixel and corresponds to a corresponding position of the one sub-pixel in the primary image, and at least one virtual sub-pixel, which has the same color as the one sub-pixel, is in a row adjacent to the corresponding position of the one sub-pixel in the primary image and is adjacent to the corresponding position.

Preferably, the step S2 comprises:

multiplying comparison components of respective comparison virtual sub-pixels of one sub-pixel by weight coefficients of the respective comparison virtual sub-pixels, and adding them up to obtain the comparison component of the sub-pixel.

Preferably, the step S3 comprises:

abstracting each of comparison components of other sub-pixels adjacent to the sub-pixel from comparison component of the sub-pixel respectively, to obtain differences, and if each of the differences exceeds the predetermined threshold value, determining the sub-pixel as a highlighted sub-pixel.

Further preferably, the threshold value is 50%, wherein the comparison component is a percentage value of a current luminance out of the maximum luminance of one sub-pixel.

Preferably, the sampling virtual sub-pixels of a sub-pixel other than the highlighted sub-pixel are the comparison virtual sub-pixels thereof.

Preferably, the sampling virtual sub-pixels of a highlighted sub-pixel include:

a virtual sub-pixel, which has the same color as the highlighted sub-pixel and corresponds to a corresponding position of the highlighted sub-pixel in the primary image, and at least one virtual sub-pixel, which has the same color as the highlighted sub-pixel, is in the same row as a corresponding position of the highlighted sub-pixel in the primary image and is adjacent to the corresponding position.

Further preferably, the at least one virtual sub-pixel, which has the same color as the highlighted sub-pixel, is in the same row as a corresponding position of the highlighted sub-pixel in the primary image and is adjacent to the corresponding position, includes:

two virtual sub-pixel, which have the same color as the highlighted sub-pixel, are in the same row as the corresponding position of the highlighted sub-pixel in the primary image and are most adjacent to the corresponding position.

Preferably, the step S4 comprises:

multiplying primary components of respective sampling virtual sub-pixels of one sub-pixel by weight coefficients of the respective sampling virtual sub-pixels, and adding them up to obtain a display component of the sub-pixel.

Further preferably, a sum of the weight coefficients of the sampling virtual sub-pixels of one sub-pixel is 1.

Further preferably, the sampling virtual sub-pixels of one sub-pixel include a main sampling virtual sub-pixel, which is a virtual sub-pixel and has the same color as the sub-pixel, and which corresponds to a corresponding position of the sub-pixel in the primary image; and among the sampling virtual sub-pixels of the sub-pixel, the main sampling virtual sub-pixel has the largest weight coefficient.

A solution to solve the above problems in the present invention is a display device comprising a display panel, wherein the display panel comprises pixels arranged in a matrix, which include multiple rows of sub-pixels, each row of sub-pixels are formed of sub-pixels of various colors which are alternately and cyclically arranged, the sub-pixels in respective rows are arranged in the same order, and in the column direction, sub-pixels of the same color are not adjacent, wherein the display device further comprising:

a primary image generating module for generating a primary image based on image information, the primary image is formed of virtual pixels arranged in a matrix, and each of the virtual pixels is formed of virtual sub-pixels of different colors arranged in one row;

a comparison component calculating module for calculating a comparison component of each sub-pixel by using primary components of comparison virtual sub-pixels of the sub-pixel, wherein comparison virtual sub-pixels of one sub-pixel include multiple virtual sub-pixels, which are adjacent to a corresponding position of the one sub-pixel in the primary image and have the same color as the one sub-pixel;

a comparing module for acquiring differences between comparison components of each sub-pixel and other sub-pixels adjacent thereto, if each of the differences between comparison components of the sub-pixel and the other sub-pixels adjacent thereto exceeds a predetermined threshold value, determining the sub-pixel as a highlighted sub-pixel; and a display component calculating module for calculating a display component of each sub-pixel by using primary components of sampling virtual sub-pixels of the sub-pixel, wherein sampling virtual sub-pixels of one sub-pixel include multiple virtual sub-pixels, which are adjacent to a corresponding position of the one sub-pixel in the primary image and have the same color as the one sub-pixel, and sampling virtual sub-pixels of the highlighted sub-pixel is selected in a different manner from that for other sub-pixels; and a display driving module for driving the sub-pixels of the display panel to display according to their respective display components.

In the display method and the display device in the present invention, a display content is first processed to be a primary image, each actual sub-pixel in the display panel corresponds to multiple virtual pixels in the primary image, and the display content of each actual sub-pixel is codetermined by multiple virtual sub-pixels adjacent thereto (sampling virtual sub-pixels). Therefore, "sharing" of the sub-pixels is realized, and a higher resolution may be obtained in visual effect. Meanwhile, a step of judging whether there is a large difference between luminance of each sub-pixel and that of any other sub-pixel adjacent thereto is included, if the judgment result is positive (YES), a different process is performed on the sub-pixel (that is, selecting different sampling virtual sub-pixels), so that too bright points in the screen are eliminated, display effect is improved and amount of calculation is small.

BRIEF DESCRIPTION OF THE DRAWINGS

FIG. 8 is a diagram illustrating a distribution of weight coefficients of sampling virtual sub-pixels of general sub-pixels in the display panel in the embodiment 1 of the invention;

REFERENCE SIGNS

1—pixel; 11—sub-pixel; 111—highlighted sub-pixel; 2—virtual pixel; 21—virtual sub-pixel; 211—comparison virtual sub-pixel; 212—sampling virtual sub-pixel.

DETAILED DESCRIPTION OF THE EMBODIMENTS

In order to make persons skilled in the art better understand solutions of the present invention, the present invention will be described in detail below in conjunction with the drawings and embodiments.

Embodiment 1

As shown in FIG. 2 to FIG. 10, the present embodiment provides a display method, which is applicable to the following display panel, the display panel comprises multiple rows of sub-pixels 11, each row of sub-pixels 11 are formed of sub-pixels 11 of various colors which are alternately and cyclically arranged, and the sub-pixels 11 in respective rows are arranged in the same order.

Preferably, the sub-pixels 11 have three colors, for example, each sub-pixel 11 may be a red sub-pixel 11, a green sub-pixel 11 or a blue sub-pixel 11 (i.e., in a RGB mode), and in the present embodiment, introduction will be made by taking the sub-pixels 11 of three colors as an example.

Figure 1:
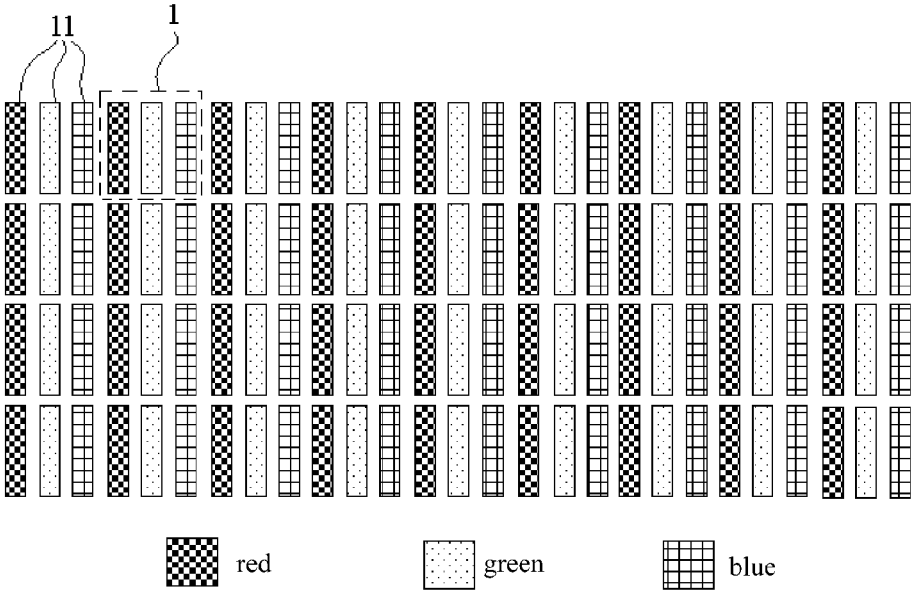
FIG. 1 is a diagram illustrating the distribution of pixels in an existing display panel.
Figure 2:
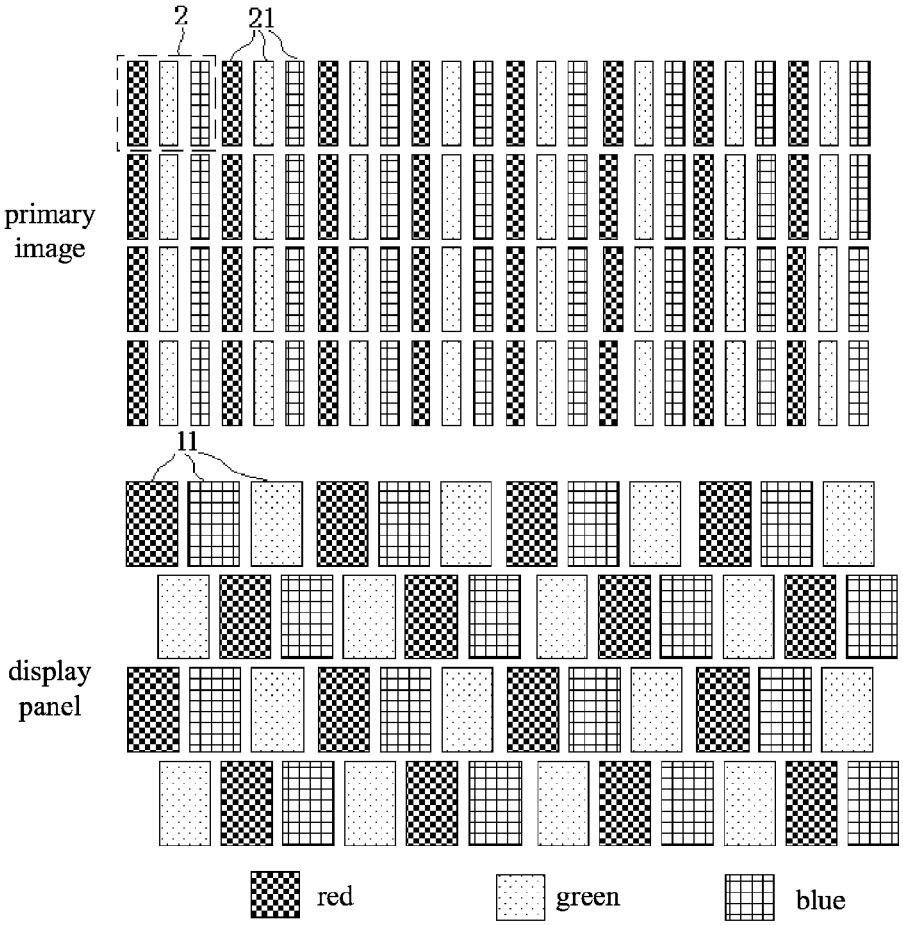
FIG. 2 is a diagram illustrating a correspondence relationship between a display panel and a primary image in an embodiment 1 of the invention.

That is to say, as shown in FIG. 2, in each row, three sub-pixels 11 of different colors form a cycle unit (for example, the cycle unit consisting of a red sub-pixel 11—a green sub-pixel 11—a blue sub-pixel 11), multiple such cycle units are repeatedly arranged so as to form a row of sub-pixels 11. Among the multiple rows of sub-pixels, starting sub-pixels may have different colors, but the sub-pixels are arranged and repeated in the same order. For example, in FIG. 2, in the first row, the first sub-pixel is a red sub-pixel 11, and the sub-pixels in the row are arranged sequentially and periodically in an order of "a red sub-pixel 11—a blue sub-pixel 11—a green sub-pixel 11—a red sub-pixel 11"; in the second row, the first sub-pixel is a green sub-pixel 11, and the sub-pixels in the row are arranged sequentially and periodically in an order of "a green sub-pixel 11—a red sub-pixel 11—a blue sub-pixel 11—a green sub-pixel 11", and it can be seen from above that, the sub-pixels 11 in these two rows are actually arranged in the same order.

The sub-pixel 11 in the display panel is preferably of a rectangle, and a ratio of length thereof in the row direction to length thereof in the column direction is 2:3.

That is to say, each of the sub-pixels 11 is of rectangular strip-shaped, and a ratio of length to width is 3:2, a length direction thereof is parallel to the column direction, and a width direction thereof is parallel to the row direction. Therefore, each of the sub-pixels 11 in the display panel in the present embodiment occupies positions of two sub-pixels in the prior art in the row direction, and in other words, each of the sub-pixels 11 in the display panel in the present embodiment corresponds to ⅔ pixels in the prior art.

Certainly, the above ratio 3:2 of length to width is based on the sub-pixels 11 of three colors, and if the number of colors of the sub-pixels 11 is changed, the ratio of length to width is accordingly changed, and is not limited to the present embodiment.

Meanwhile, in the column direction, sub-pixels 11 of the same color are not adjacent.

That is to say, in the column direction, unlike the existing display panel in which sub-pixels of the same color are arranged in one column, sub-pixels 11 of the same color are not adjacent in the present embodiment.

Moreover, preferably, any two adjacent sub-pixels 11 in the column direction are staggered by ½ sub-pixels in the row direction.

That is to say, various rows in the display panel are not aligned, namely, starting positions of any two adjacent rows are staggered by ½ sub-pixels 11, so that in the column direction, every sub-pixel 11 (except the few sub-pixels in edge regions) is adjacent to two sub-pixels 11 in its adjacent row, and is positioned at the middle of the two sub-pixels 11, it can be seen that, three sub-pixels 11 of different colors interlace to exhibit a "品" shape, and such an arrangement may result in a more uniform distribution of the sub-pixels 11 of three colors, which can further improve the display quality.

Specifically, the display panel of the present embodiment may be an organic light-emitting diode (OLED) panel, namely, each of the sub-pixels 11 thereof includes a light-emitting unit (organic light-emitting diode), and the light-emitting unit of each sub-pixel 11 directly emits light of desired color. Alternatively, the display panel may be a liquid crystal display, namely, each of the sub-pixels 11 thereof includes a color filter unit, and light transmitted through the color filter unit of the sub-pixel 11 has desired color.

In summary, the display panel may be of any of various types, so long as the distribution of the sub-pixels 11 is consistent with the above conditions, which will not be described in detail herein.

Specifically, the display method of the present embodiment comprises following steps:

S101, generating a primary image based on image information, wherein the primary image is formed of virtual pixels 2 arranged in a matrix, each virtual pixel 2 consists of three virtual sub-pixels 21 of different colors arranged in one row and is preferably square, a ratio of the size of the virtual pixel 2 to the size of the sub-pixel 11 in the row direction is preferably 3:2, and the size of the virtual pixel 21 and the size of the sub-pixel 11 in the column direction is preferably the same.

Figure 3:
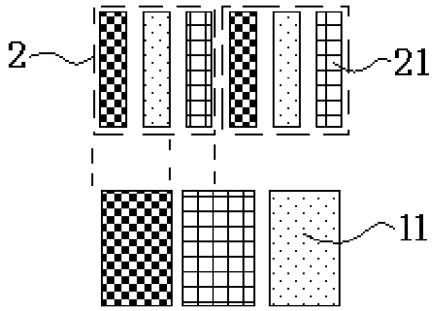
FIG. 3 is a diagram illustrating a correspondence relationship of size between sub-pixels and virtual sub-pixels in the embodiment 1 of the invention.

That is to say, as shown in FIG. 2, image information (that is, content of an image to be displayed), for example from a display card or the like, is processed to generate a primary image, the primary image is formed of a plurality of "virtual pixels 2" arranged in a matrix, and each of the virtual pixels 2 is equivalent to a square "point" in the primary image, and consists of three virtual sub-pixels 21 of different colors (in other words, the primary image is an image to be displayed in the existing display panel). Meanwhile, as shown in FIG. 3, in the column direction, the size of each virtual pixel 2 is the same as that of a sub-pixel 11 in the display panel of the present embodiment, whereas in the column direction, two virtual pixels 2 (namely, six virtual sub-pixels 21) correspond to three sub-pixels 11, so that a ratio of the size of the virtual pixel 2 to the size of the sub-pixel 11 in the row direction is 3:2. It can be seen that, each sub-pixel 11 in the display panel corresponds to two virtual sub-pixels 21 in the primary image or corresponds to ⅔ virtual pixels 2.

S102, calculating a comparison component of each sub-pixel 11 by using comparison components of comparison virtual sub-pixels 211 of the sub-pixel 11, wherein comparison virtual sub-pixels 211 of one sub-pixel 11 include multiple virtual sub-pixels 21, which are adjacent to a corresponding position of the one sub-pixel 11 in the primary image and have the same color as the one sub-pixel 11.

The "component" in the "primary component", "display component" and "comparison component" or the like refers to a quantity of color to be displayed by a corresponding virtual sub-pixel 21 or sub-pixel 11, and can be represented as "brightness". Of course, so long as the "component" may represent the "quantity" to be displayed, it may be possible to use any other measurement parameter, such as "gray level (grayscale)", "saturation" and the like, as unit of the "component".

Figure 4:
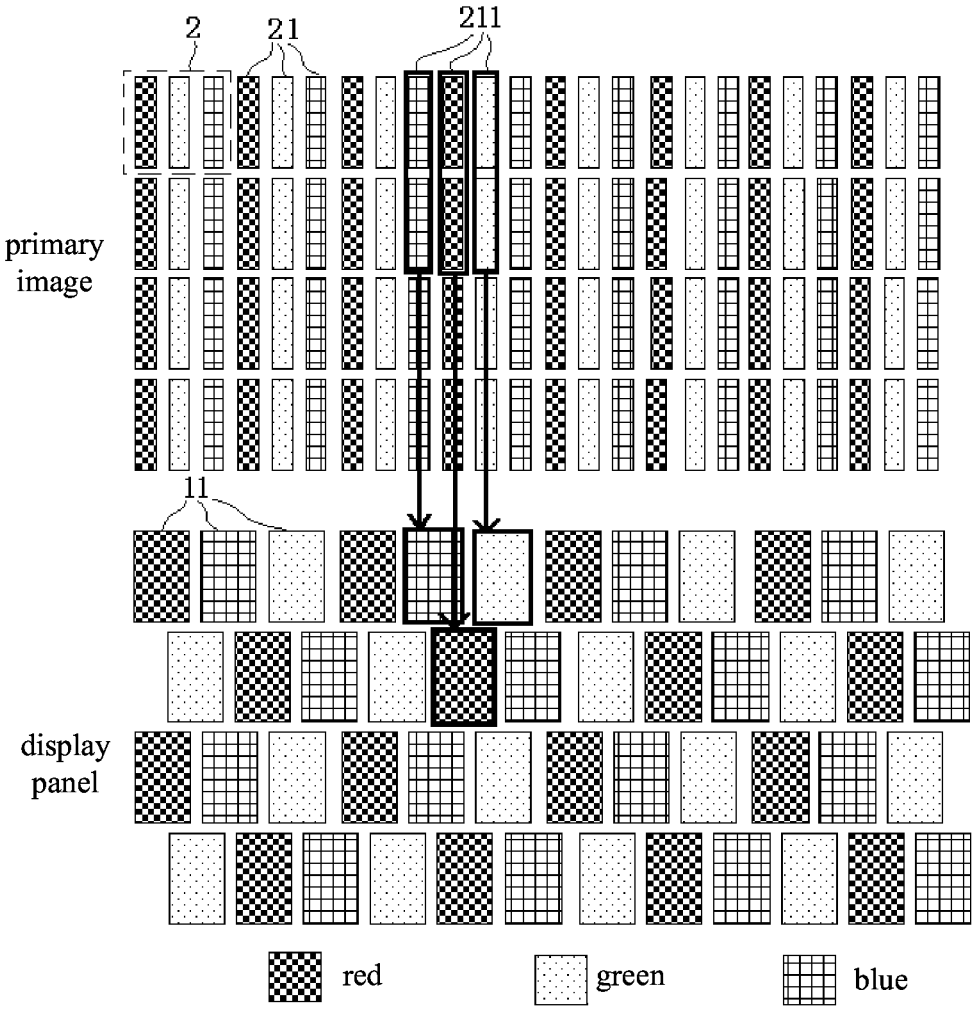
FIG. 4 is a diagram illustrating a correspondence relationship between sub-pixels in the display panel and comparison virtual sub-pixels in the embodiment 1 of the invention.

Preferably, as shown in FIG. 4, the comparison virtual sub-pixels 211 of a sub-pixel 11 comprise: a virtual sub-pixel 21, which corresponds to a corresponding position of the sub-pixel 11 in the primary image (which is referred to as a corresponding position for short blow) and has the same color as the sub-pixel 11, and at least one virtual sub-pixel 21, which is in a row adjacent to the corresponding position of the sub-pixel 11 in the primary image, adjacent to the corresponding position of the sub-pixel 11 and has the same color as the sub-pixel 11.

That is to say, as shown in FIG. 4, position occupied by each sub-pixel 11 corresponds to two virtual sub-pixels 21 in the primary image, if one of the two virtual sub-pixels 21 has the same color as the sub-pixel 11 (the red sub-pixel 11 with thick continuous frame in the figure), the one of the two virtual sub-pixels 21 (the red virtual sub-pixel 21 with thick continuous frame in the figure) is a comparison virtual sub-pixel 211 of the sub-pixel 11. Furthermore, if there is another virtual sub-pixel 21 adjacent to the corresponding position of the sub-pixel 11 and having the same color as the sub-pixel 11 (the red sub-pixel 11 with thick continuous frame in the figure), the another virtual sub-pixel 21 (the red virtual sub-pixel 21 with thick continuous frame in the figure) may also be a comparison virtual sub-pixel 211 of the sub-pixel 11. Certainly, there are generally two rows adjacent to the corresponding position of the sub-pixel 11, the virtual sub-pixels 21 adjacent to the corresponding position of the sub-pixel 11 having the same color as the sub-pixel 11 exist in both the two rows, and in this case, one or both of the virtual sub-pixels 21 may be selected as the comparison virtual sub-pixels 211. Similarly, selection of the comparison virtual sub-pixels 211 (which is depicted with thick continuous frame) may be similarly made with respect to the green sub-pixel 11 and the yellow sub-pixel 11 with thick continuous frame.

After the comparison virtual sub-pixels 211 are selected, a comparison component of each sub-pixel 11 may be calculated based on the comparison virtual sub-pixels 211.

That is to say, according to the display content of the comparison virtual sub-pixels 211, a related parameter of each sub-pixel 11 is calculated, and the related parameter may be obtained by using the following calculation.

The calculation of the above comparison component is as follows: multiplying the primary components of the comparison virtual sub-pixels 211 of the one sub-pixel 11 by respective weight coefficients of the comparison virtual sub-pixels and adding them up to obtain the display component of the sub-pixel 11.

That is to say, the comparison component of each sub-pixel 11 may be codetermined by the primary components of multiple virtual sub-pixels 21 of the same color as the sub-pixel 11 around the corresponding position of the sub-pixel 11 (comparison virtual sub-pixels 211) and assigned weights thereof, in other words, certain amounts of respective components may be "extracted" from all of the comparison virtual sub-pixels 211 of one sub-pixel 11 according to their proportions and added up so as to obtain a comparison component of the sub-pixel 11. For example, for a case in which each sub-pixel 11 corresponds to two comparison virtual sub-pixels 211, a weight coefficient of the comparison virtual sub-pixel 211, position of which directly overlaps with the sub-pixel 11, may be set to 0.7, and a weight coefficient of the other comparison virtual sub-pixel 211 may be set to 0.3, then respective primary components of the two comparison virtual sub-pixels 211 are multiplied by 0.7 and 0.3 respectively and added up, and a resultant value is the comparison component of the sub-pixel 11.

S103, acquiring differences between comparison components of each sub-pixel 11 and other sub-pixels 11 adjacent thereto, if each of the differences between comparison components of one sub-pixel and the other sub-pixels adjacent thereto exceeds a predetermined threshold value, determining the sub-pixel 11 as a highlighted sub-pixel 111.

Figures 5, 6:
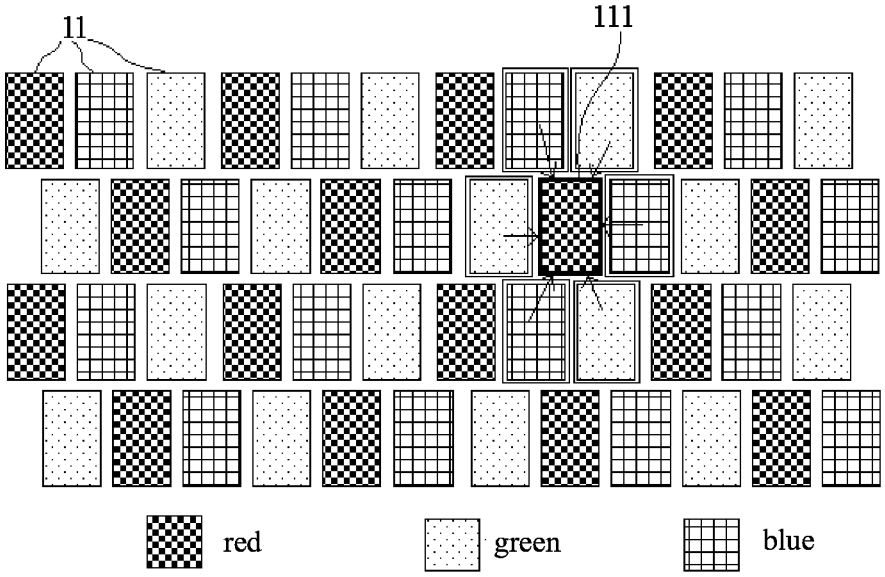
FIG. 5 is a diagram illustrating a procedure for comparing a highlighted sub-pixel with sub-pixels adjacent thereto in the display panel in the embodiment 1 of the invention.
FIG. 6 is a diagram illustrating a distribution of comparison components of a highlighted sub-pixel and sub-pixels adjacent thereto in the display panel in the embodiment 1 of the invention.

That is to say, as shown in FIG. 5, as each sub-pixel 11 is certainly adjacent to multiple other sub-pixels 11, the comparison component of each sub-pixel 11 is compared with the comparison components of the multiple other sub-pixels 11 one by one, and if luminance of the sub-pixel 11 is remarkably larger than that of each of the sub-pixels 11 adjacent thereto, then the sub-pixel 11 is determined to be a highlighted sub-pixel 111.

In this step, the remarkably bright sub-pixel 11 (the highlighted sub-pixel 111) in the display panel is picked out and will be processed by using a different method from that for other "common" sub-pixels 11 in subsequent steps, so that final display effect is improved.

Preferably, the above comparing method may be as follows: abstracting each of comparison components of sub-pixels 11 adjacent to one sub-pixel 11 from comparison component of the one sub-pixel 11, respectively, to obtain differences, if each of the differences exceeds the predetermined threshold value, determining the one sub-pixel 11 as one highlighted sub-pixel 111.

That is to say, when the comparison component of the one sub-pixel 11 exceeds that of any sub-pixel therearound by a specific value, the sub-pixel 11 is determined to be the highlighted sub-pixel 111.

Specifically, the threshold value is 50%, and a comparison component may be a percentage value of current luminance of a sub-pixel 11 occupying the maximum luminance thereof.

That is to say, for an arbitrary sub-pixel 11, its reachable maximum luminance is 100% (of course its reachable minimum luminance is 0%), accordingly, its luminance at a certain timing may be certainly indicated by a value between 0% and 100%, and at this time, this percentage value represents the comparison component. When the comparison component of the one sub-pixel 11 exceeds that of any sub-pixel therearound by at least 50%, the sub-pixel 11 may be determined as the highlighted sub-pixel 111. FIG. 6 shows judgment for part of highlighted sub-pixels 11, wherein a central number in each number set represents the luminance of the highlighted sub-pixel 11, and other numbers therearound represent luminances of other sub-pixels 11 at corresponding positions, it can be seen that, the central number is larger than any number therearound by at least 50%, therefore, the sub-pixel 11 having the central number may be determined as the highlighted sub-pixel 111. When the luminance of the highlight sub-pixel 111 is larger than that of each of the sub-pixels 11 therearound by at least 50%-80%, the display effect obtained through the inventive method is the best.

S104, calculating a display component of each sub-pixel 11 by using primary components of sampling virtual sub-pixels 212 of the sub-pixel 11, wherein sampling virtual sub-pixels 212 of one sub-pixel 11 include multiple virtual sub-pixels 21, which are adjacent to a corresponding position of the one sub-pixel 11 in the primary image and have the same color as the one sub-pixel 11, and sampling virtual sub-pixels 212 of the highlighted sub-pixel 111 are selected in a different manner from that for other sub-pixels.

In the display method of the present embodiment, each sub-pixel 11 occupies positions of two virtual sub-pixels 21 in the primary image, that is, the number of the sub-pixels 11 is smaller than that of virtual sub-pixels 21, therefore, the content displayed by each sub-pixel 11 must be codetermined by multiple virtual sub-pixels 21, thus the image quality can be assured not to be decreased.

Thus, multiple virtual sub-pixels 21 near the corresponding position of each sub-pixel 11 may be selected as sampling virtual sub-pixels 212, and the display component of the sub-pixel 11 is calculated by using primary components of the sampling virtual sub-pixels 212. Meanwhile, the highlighted sub-pixels 111 as "bright points" are found through a comparison manner in the above step 103, in order to avoid the highlighted sub-pixels 111 to affect display effect due to too high display brightness, and therefore, with respect to the highlighted sub-pixels 111, a method for selecting the sampling virtual sub-pixels 212 thereof should be different.

Figure 7:
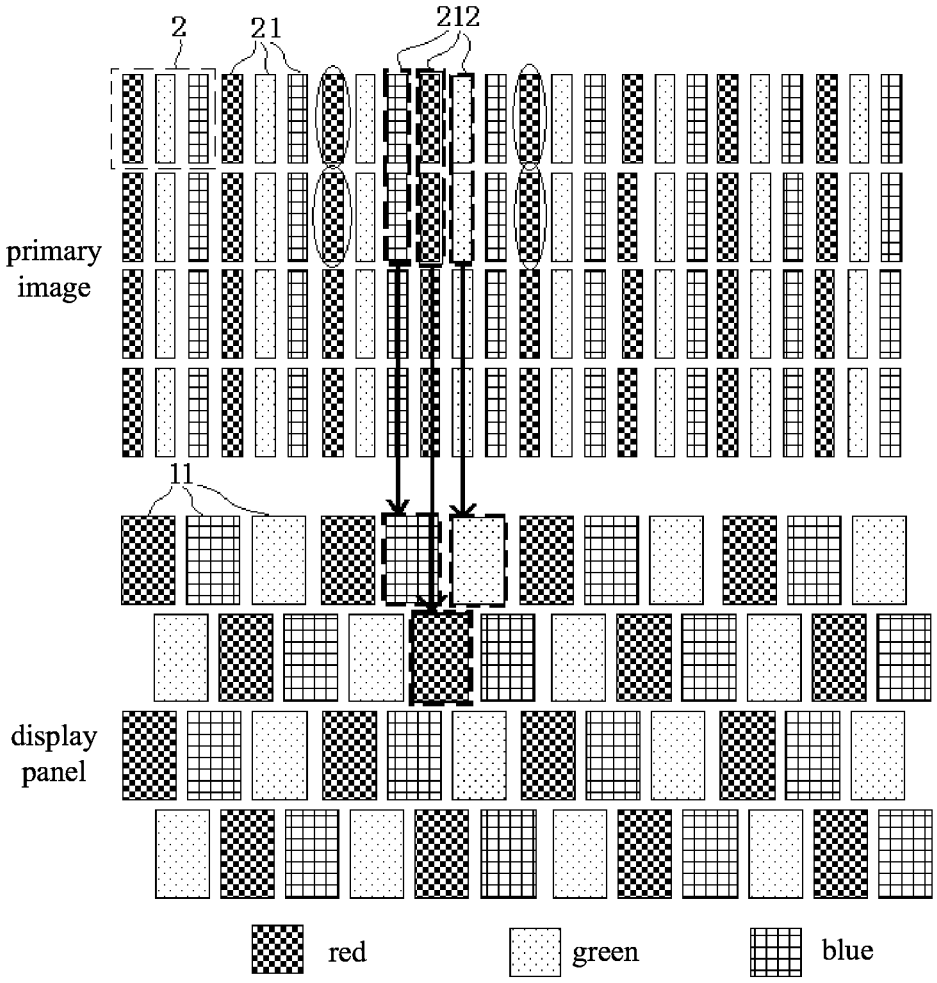
FIG. 7 is a diagram illustrating a correspondence relationship between common sub-pixels in the display panel and sampling virtual sub-pixels in the embodiment 1 of the invention.

Preferably, as shown in FIG. 7, with respect to sub-pixels 11 other than the highlighted sub-pixels 111, the sampling virtual sub-pixels 212 thereof are the comparison virtual sub-pixels 211 thereof.

That is to say, as shown in FIG. 7, with respect to "general" sub-pixels 11 which are judged as non-highlighted sub-pixels in the step S103, the sampling virtual sub-pixels 212 thereof may be selected in the same manner as the comparison sub-pixels 211. For example, with respect to the sub-pixel 11 with thick dotted frame, the sampling virtual sub-pixels 212 corresponding thereto may also include one virtual sub-pixel 21 having the same color directly corresponding to the corresponding position, and another virtual sub-pixel 21 having the same color in a row adjacent to the corresponding position of the sub-pixel in the primary image and contacting the one virtual sub-pixel 21 (i.e. the virtual sub-pixel 21 with thick dotted frame in the drawing), and it can be seen that, in fact, these sampling virtual sub-pixels 212 are the same as the comparison virtual sub-pixels 211 in FIG. 4.

Preferably, the above step of calculating a display component of each sub-pixel 11 by using primary components of sampling virtual sub-pixels 212 of the sub-pixel 11 may specifically include: multiplying primary components of respective sampling virtual sub-pixels 212 of the sub-pixel 11 by weight coefficients of the respective sampling virtual sub-pixels 212, and adding them up to obtain a display component of the sub-pixel 11.

That is to say, the display content of each sub-pixel 11 may be codetermined by the display contents of multiple virtual sub-pixels 21 of the same color as the sub-pixel 11 around the corresponding position of the sub-pixel 11 in the primary image (sampling virtual sub-pixels 212) and assigned weights thereof; in other words, certain amounts of respective components may be "extracted" from all of the sampling virtual sub-pixels 212 of one sub-pixel 11 according to their proportions and added up so as to obtain a component to be displayed by the sub-pixel 11.

Preferably, the sum of the weight coefficients of all sampling virtual sub-pixels 212 of one sub-pixel 11 is 1.

Apparently, when the sum of the weight coefficients of the sampling virtual sub-pixels 212 is 1, compared to the overall brightness of the primary image, the overall brightness of the display panel will not be increased or reduced, thus ensuring that the displayed picture may not be changed.

Preferably, the sampling virtual sub-pixels 212 of one sub-pixel 11 include a main sampling virtual sub-pixel 212, which is a virtual sub-pixel 21 and has the same color as the sub-pixel 11, and corresponds to a corresponding position of the sub-pixel 11 in the primary image; among the sampling virtual sub-pixels 212 of one sub-pixel 11, the main sampling virtual sub-pixel 212 has the largest weight coefficient.

Apparently, for a sub-pixel 11, the further the distance from a sampling virtual sub-pixel 212 to the corresponding position of the sub-pixel 11 is, the less the sampling virtual sub-pixel 212 has influence on the content of the sub-pixel 11; and the main sampling virtual sub-pixel 212 is a sampling virtual sub-pixel 212, which is directly overlapped with (that is, corresponds to) the corresponding position of the sub-pixel 11 in the primary image, therefore, the distance between the main sampling virtual sub-pixel 212 and the corresponding position is smallest, thus the main sampling virtual sub-pixel 212 has the largest influence on the sub-pixel 11, and the weight of the main sampling virtual sub-pixel 212 should be the largest.

The weight coefficient of any other sampling virtual sub-pixel 212 may be a negative value or zero; when the weight coefficient of one sampling virtual sub-pixel 212 is a negative value, it may actually reduce the display component of the sub-pixel 11 so as to correct the display component of the sub-pixel 11; and when the weight coefficient of one sampling virtual sub-pixel 212 is zero, it can be regarded to have no influence on the display component of the sub-pixel 11.

At this time, for three sub-pixels 11 with thick dotted frame in FIG. 7, the weight coefficients corresponding to the sampling virtual sub-pixels 212 of these sub-pixels may be those shown in FIG. 8, wherein the numerals represent the weight coefficients corresponding to the sampling virtual sub-pixels 212, which are at corresponding positions and have desired colors, wherein the largest coefficient in each coefficient set is the weight coefficient of the main sampling virtual sub-pixel 212, i.e., the weight coefficient of the sampling virtual sub-pixel 212 overlapping with the corresponding position of the sub-pixel 11 in the primary image. In figures, the weight coefficients of the sampling virtual sub-pixels 212 of each color may be assigned in various manners, which may be decided as desired.

Of course, it should be understood that, the selection method of the sampling virtual sub-pixels 212 is not used to limit the present embodiment, and a person skilled in the art may also select other virtual sub-pixels 21 as the sampling virtual sub-pixels 212 as desired. For example, for the red sub-pixel 11 with thick dotted frame in FIG. 7, the sampling virtual sub-pixels 212 thereof may also include four red virtual sub-pixels 21 with circles in the figure, and accordingly, for the green sub-pixel 11 and the blue sub-pixel 11, more sampling virtual sub-pixels 212 may also be selected.

When more sampling virtual sub-pixels 212 are included, assignment of their weight coefficients may be shown by numerals such as (3), (4), (7), (8), (11) and (12) in FIG. 8.

Figures 9, 10:
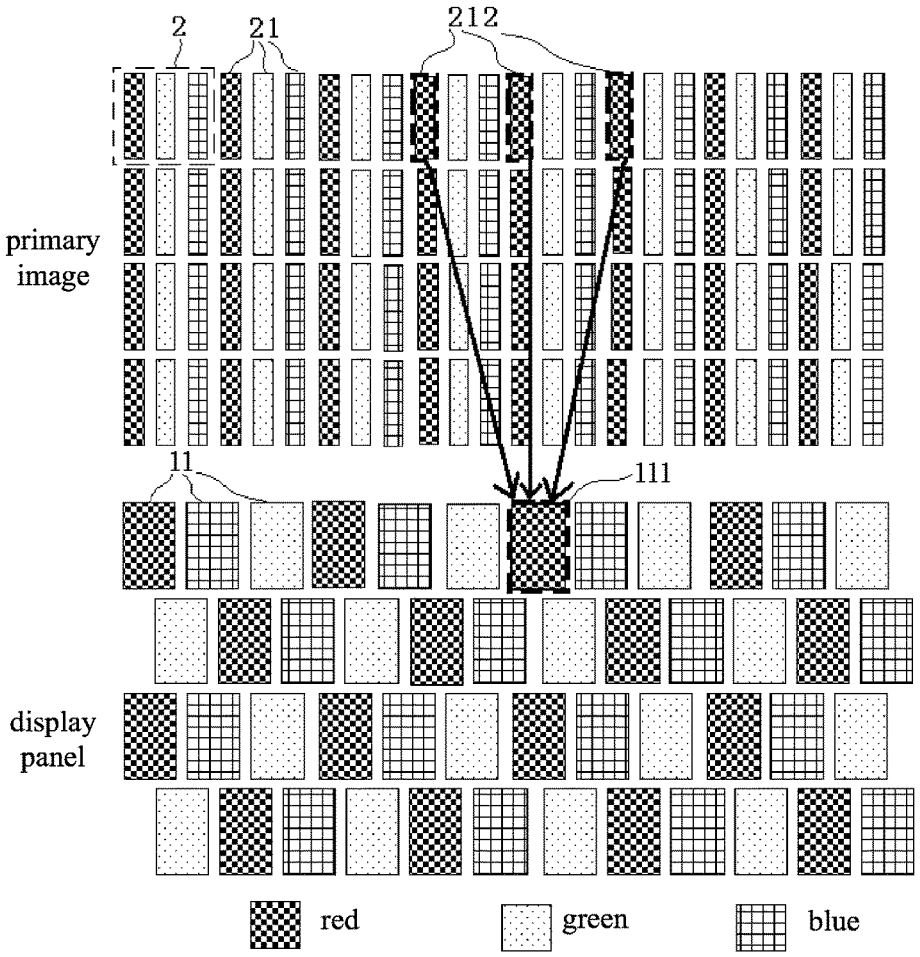
FIG. 9 is a diagram illustrating a correspondence relationship between a highlighted sub-pixel in the display panel and sampling virtual sub-pixels in the embodiment 1 of the invention.
FIG. 10 is a diagram illustrating a distribution of weight coefficients of sampling virtual sub-pixels of a highlighted sub-pixel in the display panel in the embodiment 1 of the invention.

Preferably, as shown in FIG. 9, for the highlighted sub-pixel 111 (the red highlighted sub-pixel 111 with thick dotted frame in the figure), its sampling virtual sub-pixels 212 may include: a virtual sub-pixel 21, which has the same color as the sub-pixel 11 and corresponds to a corresponding position of the sub-pixel 11 in the primary image, and at least one virtual sub-pixel 21, which has the same color as the sub-pixel 11, is in a row adjacent to the corresponding position of the sub-pixel 11 in the primary image and is most adjacent to the corresponding position, and is preferably the most adjacent two virtual sub-pixels 21 of the same color in one row.

That is to say, for the highlighted sub-pixel 111, its sampling virtual sub-pixels 212 are preferably selected in a transverse direction, that is, in addition to the main sampling virtual sub-pixel 212, its sampling virtual sub-pixels 212 include at least one (preferably two) of the virtual sub-pixels 21 of the same color on both sides of the main sampling virtual sub-pixel 212. With respect to the above red highlighted sub-pixel 111, the weight coefficients of its sampling virtual sub-pixels 212 may be shown in FIG. 10, wherein the weight coefficient of the main sampling virtual sub-pixel 212 is the largest, and the weight coefficients of the sampling virtual sub-pixel 212 on both sides of the main sampling virtual sub-pixel 212 are small.

Certainly, it should be understood that, the selection method of the sampling virtual sub-pixels 212 is not used to limit the present embodiment, and a person skilled in the art may also select other virtual sub-pixels 21 as the sampling virtual sub-pixels 212 as desired, so long as selection method thereof is different from that of a general sub-pixel 11.

Meanwhile, it should be noted that, if a certain sub-pixel 11 is a highlighted sub-pixel 111, then other sub-pixels 11 adjacent thereto must be non-highlighted, as brightness of each of these sub-pixels is smaller than that of the highlighted sub-pixel 111. Thus, the selection method of the sampling virtual sub-pixels 212 of the highlighted sub-pixel 111 must be different from that of other sub-pixels 11 therearound.

When the above selection method of the sampling virtual sub-pixels 212 and the above weight coefficient range are adopted, good display effect can be realized. It should be understood that, the above selection method of the sampling virtual sub-pixels 212, the above weight coefficient range and the like are not used to limit the present invention, and there may be many modifications of the display method of the present invention.

In the display method of the present embodiment, a display content is first processed to be a primary image, each actual sub-pixel in the display panel corresponds to multiple virtual sub-pixels in the primary image, and the display content of each actual sub-pixel is codetermined by multiple virtual sub-pixels adjacent to a corresponding position of the sub-pixel in the primary image (sampling virtual sub-pixels). Therefore, "sharing" of the sub-pixels is realized, and a higher resolution may be obtained in visual effect. Meanwhile, a step of judging whether there is a large difference between luminance of each sub-pixel and that of any other sub-pixel adjacent thereto is included, if the judgment result is positive (YES), a different process is performed on the sub-pixel (that is, selecting different sampling virtual sub-pixels), so that too bright points in the screen are eliminated, display effect is improved and amount of calculation is small.

In the above embodiment, the invention has been described by taking a display panel (or primary image) comprising sub-pixels (or virtual sub-pixels) of three colors as an example. However, it should be understood that, the display panel may also comprise sub-pixels of more than three colors, for example, sub-pixels of red, green, blue and white colors (a RGBW mode), or sub-pixels of red, green, blue and yellow colors (a RGBY mode) and the like. When sub-pixels of more than three colors are comprised, the ratio of length to width of each sub-pixel may not be 3:2 any longer, and the display method is changed accordingly, for example, when sub-pixels of white color are comprised, each of the sub-pixels of white color is used to compensate for luminance, thus the sub-pixels of white color may not be subjected to the above "sampling" process, but are decided whether to be lighted up according to the overall luminance. When sub-pixels of yellow color are comprised, the sub-pixels of yellow color may be selected by using a method similar to the above method, of course, the selection of comparison virtual sub-pixels, the selection of the sampling virtual sub-pixels, assignment of the weight coefficients and the like may be changed, and however, as these contents may be decided by a person skilled in the art as desired, detail description thereof will be omitted herein.

Embodiment 2

The present embodiment provides a display device comprising a display panel, wherein the display panel comprises pixels arranged in a matrix, which include multiple rows of sub-pixels, each row of sub-pixels are formed of sub-pixels of various colors which are alternately and cyclically arranged, the sub-pixels in respective rows are arranged in the same order, and in the column direction, sub-pixels of the same color are not adjacent, wherein the display device further comprising:

a primary image generating module for generating a primary image based on image information, the primary image is formed of virtual pixels arranged in a matrix, each of the virtual pixels is formed of virtual sub-pixels of different colors arranged in one row;

a comparison component calculating module for calculating a comparison component of each sub-pixel by using primary components of comparison virtual sub-pixels of the sub-pixel, wherein comparison virtual sub-pixels of one sub-pixel include multiple virtual sub-pixels, which are adjacent to a corresponding position of the one sub-pixel in the primary image and have the same color as the one sub-pixel;

a comparing module for acquiring differences between comparison components of each sub-pixel and other sub-pixels adjacent thereto, if each of the differences between comparison components of one sub-pixel and the other sub-pixels adjacent thereto exceeds a predetermined threshold value, determining the sub-pixel as a highlighted sub-pixel; and a display component calculating module for calculating a display component of each sub-pixel by using primary components of sampling virtual sub-pixels of the sub-pixel, wherein sampling virtual sub-pixels of one sub-pixel include multiple virtual sub-pixels, which are adjacent to a corresponding position of the one sub-pixel in the primary image and have the same color as the one sub-pixel, and sampling virtual sub-pixels of the highlighted sub-pixel is selected in a different manner from that for other sub-pixels; and a display driving module for driving the sub-pixels of the display panel to display according to their respective display components.

In the display device in the present embodiment using the display method provided by the embodiment of the invention, the visual resolution is relatively high, and the display effect is improved, and meanwhile, amount of calculation is reduced.

The display device of the embodiment may be any product or part which is provided with a display function such as a liquid crystal panel, an electronic paper, an organic light emitting diode (OLED) panel, a liquid crystal TV, a liquid crystal display, a digital image frame, a mobile phone, and a tablet computer.

It should be understood that, the above embodiments are only exemplary embodiments used to explain the principle of the present invention and the protection scope of the present invention is not limited thereto. The person skilled in the art can make various variations and modifications without departing from the spirit and scope of the present invention, and these variations and modifications should be considered to belong to the protection scope of the invention.

The invention claimed is:

1. A display method, which is applicable to a display panel comprising multiple rows of sub-pixels, each row of sub-pixels are formed of sub-pixels of various colors which are alternately and cyclically arranged, the sub-pixels in respective rows are arranged in the same order, and in the column direction, sub-pixels of the same color are not adjacent, wherein the display method comprises steps of:

S1, generating a primary image based on image information, wherein the primary image is formed of virtual pixels arranged in a matrix, and each of the virtual pixels is formed of virtual sub-pixels of different colors arranged in one row;

S2, calculating a comparison component of each sub-pixel by using primary components of comparison virtual sub-pixels of the sub-pixel, wherein comparison virtual sub-pixels of the sub-pixel include multiple virtual sub-pixels, which are adjacent to a corresponding position of the sub-pixel in the primary image and have the same color as the sub-pixel;

S3, acquiring differences between comparison components of each sub-pixel and other sub-pixels adjacent thereto, if each of the differences between comparison components of the sub-pixel and the other sub-pixels adjacent thereto exceeds a predetermined threshold value, determining the sub-pixel as a highlighted sub-pixel; and S4, calculating a display component of each sub-pixel by using primary components of sampling virtual sub-pixels of the sub-pixel, wherein sampling virtual sub-pixels of the sub-pixel include multiple virtual sub-pixels, which are adjacent to a corresponding position of the sub-pixel in the primary image and have the same color as the sub-pixel, and sampling virtual sub-pixels of the highlighted sub-pixel are selected in a different manner from that for other sub-pixels.

2. The display method of claim 1, wherein any two adjacent sub-pixels in the column direction are staggered by ½ sub-pixels in the row direction.

3. The display method of claim 2, wherein the step S4 comprises:

multiplying primary components of respective sampling virtual sub-pixels of the sub-pixel by weight coefficients of the respective sampling virtual sub-pixels, and adding them up to obtain the display component of the sub-pixel.

4. The display method of claim 1, wherein the virtual pixel is square, and size thereof in the column direction is the same as that of a sub-pixel of the display panel.

5. The display method of claim 4, wherein each row of sub-pixels in the display panel are formed of sub-pixels of three colors which are alternately and cyclically arranged, and each row of virtual sub-pixels of the primary image consists of three virtual sub-pixels of different colors which are alternately and cyclically arranged;

the sub-pixel is rectangular, and a ratio of length thereof in the row direction to length thereof in the column direction is 2:3; and a ratio of the size of the virtual pixel to that of the sub-pixel in the row direction is 3:2.

6. The display method of claim 5, wherein the step S4 comprises:

multiplying primary components of respective sampling virtual sub-pixels of the sub-pixel by weight coefficients of the respective sampling virtual sub-pixels, and adding them up to obtain the display component of the sub-pixel.

7. The display method of claim 4, wherein the step S4 comprises:

multiplying primary components of respective sampling virtual sub-pixels of the sub-pixel by weight coefficients of the respective sampling virtual sub-pixels, and adding them up to obtain the display component of the sub-pixel.

8. The display method of claim 1, wherein the comparison sub-pixels of the sub-pixel include:

a virtual sub-pixel, which has the same color as the sub-pixel and corresponds to a corresponding position of the sub-pixel in the primary image, and at least one virtual sub-pixel, which has the same color as the sub-pixel, is in a row adjacent to the corresponding position of the sub-pixel in the primary image and is adjacent to the corresponding position.

9. The display method of claim 8, wherein the step S4 comprises:

multiplying primary components of respective sampling virtual sub-pixels of the sub-pixel by weight coefficients of the respective sampling virtual sub-pixels, and adding them up to obtain the display component of the sub-pixel.

10. The display method of claim 1, wherein the step S2 comprises:

multiplying comparison components of respective comparison virtual sub-pixels of the sub-pixel by predetermined weight coefficients of the respective comparison virtual sub-pixels, and adding them up to obtain the comparison component of the sub-pixel.

11. The display method of claim 10, wherein the step S4 comprises:

multiplying primary components of respective sampling virtual sub-pixels of the sub-pixel by weight coefficients of the respective sampling virtual sub-pixels, and adding them up to obtain the display component of the sub-pixel.

12. The display method of claim 1, wherein the step S3 comprises:

subtracting each of comparison components of other sub-pixels adjacent to the sub-pixel from comparison component of the sub-pixel, respectively, to obtain differences, and if each of the differences exceeds the predetermined threshold value, determining the sub-pixel as a highlighted sub-pixel.

13. The display method of claim 12, wherein the threshold value is 50%, and wherein the comparison component is a percentage value of a current luminance of the sub-pixel occupying a maximum luminance of the sub-pixel.

14. The display method claim 1, wherein the sampling virtual sub-pixels of a sub-pixel other than the highlighted sub-pixel are the comparison virtual sub-pixels thereof.

15. The display method of claim 1, wherein the sampling virtual sub-pixels of the highlighted sub-pixel include:

a virtual sub-pixel, which has the same color as the highlighted sub-pixel and corresponds to a corresponding position of the highlighted sub-pixel in the primary image, and at least one virtual sub-pixel, which has the same color as the highlighted sub-pixel, is in the same row as the corresponding position of the highlighted sub-pixel in the primary image and is adjacent to the corresponding position.

16. The display method of claim 15, wherein the at least one virtual sub-pixel, which has the same color as the highlighted sub-pixel, is in the same row as the corresponding position of the highlight sub-pixel in the primary image and is adjacent to the corresponding position, includes:

two virtual sub-pixel, which have the same color as the highlighted sub-pixel, are in the same row as the corresponding position of the highlighted sub-pixel in the primary image and are most adjacent to the corresponding position.

17. The display method of claim 1, wherein the step S4 comprises:

multiplying primary components of respective sampling virtual sub-pixels of the sub-pixel by weight coefficients of the respective sampling virtual sub-pixels, and adding them up to obtain the display component of the sub-pixel.

18. The display method of claim 17, wherein a sum of the weight coefficients of the sampling virtual sub-pixels of the sub-pixel is 1.

19. The display method of claim 17, wherein the sampling virtual sub-pixels of the sub-pixel include a main sampling virtual sub-pixel, which is a virtual sub-pixel and has the same color as the sub-pixel, and which corresponds to the corresponding position of the sub-pixel in the primary image; and among the sampling virtual sub-pixels of the sub-pixel, the main sampling virtual sub-pixel has the largest weight coefficient.

20. A display device comprising a display panel, the display panel comprises pixels arranged in a matrix, which include multiple rows of sub-pixels, each row of sub-pixels are formed of sub-pixels of various colors which are alternately and cyclically arranged, the sub-pixels in respective rows are arranged in the same order, and in the column direction, sub-pixels of the same color are not adjacent, wherein the display device comprises a processor, and the processor performs the following steps:

generating a primary image based on image information, the primary image is formed of virtual pixels arranged in a matrix, and each of the virtual pixels is formed of virtual sub-pixels of different colors arranged in one row;

calculating a comparison component of each sub-pixel by using primary components of comparison virtual sub-pixels of the sub-pixel, wherein comparison virtual sub-pixels of the sub-pixel include multiple virtual sub-pixels, which are adjacent to a corresponding position of the sub-pixel in the primary image and have the same color as the sub-pixel;

acquiring differences between comparison components of each sub-pixel and other sub-pixels adjacent thereto, if each of the differences between comparison components of the sub-pixel and the other sub-pixels adjacent thereto exceeds a predetermined threshold value, determining the sub-pixel as a highlighted sub-pixel; and calculating a display component of each sub-pixel by using primary components of sampling virtual sub-pixels of the sub-pixel, wherein sampling virtual sub-pixels of the sub-pixel include multiple virtual sub-pixels, which are adjacent to the corresponding position of the sub-pixel in the primary image and have the same color as the sub-pixel, and sampling virtual sub-pixels of the highlighted sub-pixel is selected in a different manner from that for other sub-pixels; and driving the sub-pixels of the display panel to display according to their respective display components.

* * * * *